United States Patent [19]

Belvederi

[11] Patent Number: 5,010,903

[45] Date of Patent: Apr. 30, 1991

[54] CONTINUOUS-WORM CIGARETTE-MAKING MACHINE

[75] Inventor: Bruno Belvederi, Bologna, Italy

[73] Assignee: G.D. S.p.A., Bologna, Italy

[21] Appl. No.: 313,413

[22] Filed: Feb. 21, 1989

[30] Foreign Application Priority Data

Mar. 4, 1988 [IT] Italy ..... 3358 A/88

[51] Int. Cl.[5] ..... A24C 5/18

[52] U.S. Cl. ..... 131/84.3; 131/84.1

[58] Field of Search ..... 131/84.1, 84.3

[56] References Cited

U.S. PATENT DOCUMENTS 3,242,927 3/1966 Labbe ..... 131/84.3

FOREIGN PATENT DOCUMENTS 2265290 3/1975 France .
2490460 3/1982 France .
0974821 11/1964 United Kingdom .
2000675 1/1979 United Kingdom .

*Primary Examiner*—V. Millin
*Attorney, Agent, or Firm*—Guido Modiano; Albert Josif

[57] ABSTRACT

Cigarette-making machine, comprising a chimney for upwardly feeding a continuous flow of tobacco particles, and a suction conveyor for forming and transferring a layer of tobacco particles, arranged above the chimney and constituted by an air-permeable belt closed in a loop around two end rollers; inside said loop there is a box-like body connected to suction source and defining a longitudinal opening closed by the lower stringer of the belt; a shaped strip is provided inside the box-like body and in contact with the lower stringer, and acts as an element contrasting the action exerted by the suction source on the lower stringer through the opening.

2 Claims, 1 Drawing Sheet

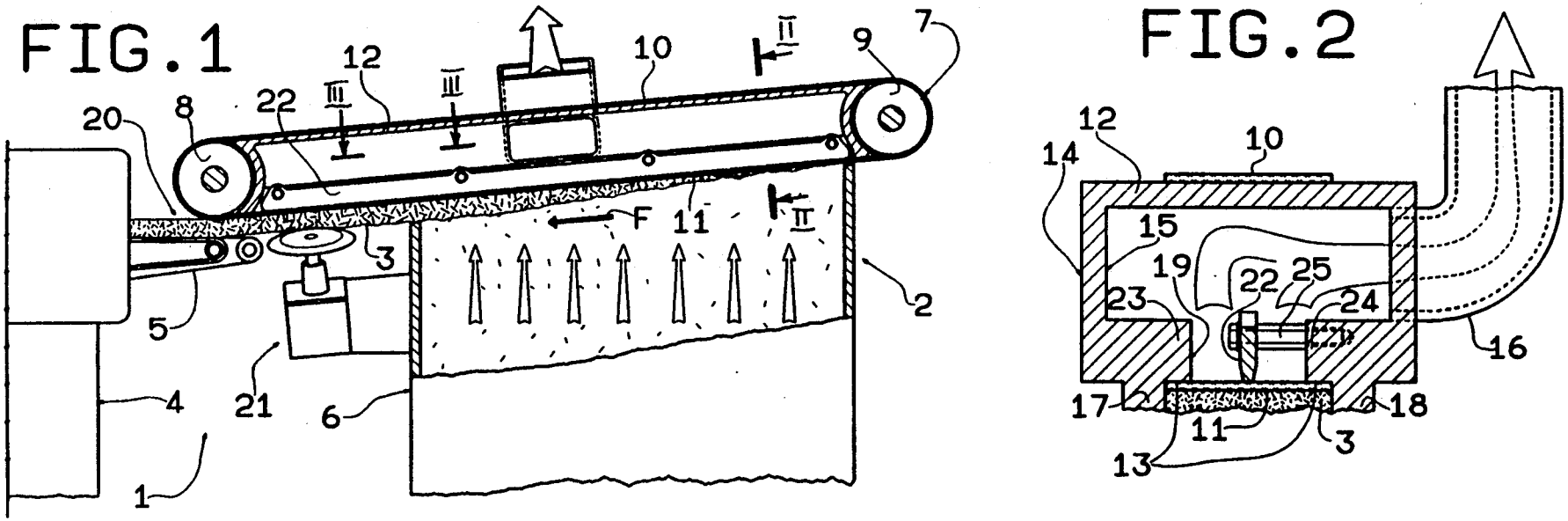
FIG. 1
FIG. 2
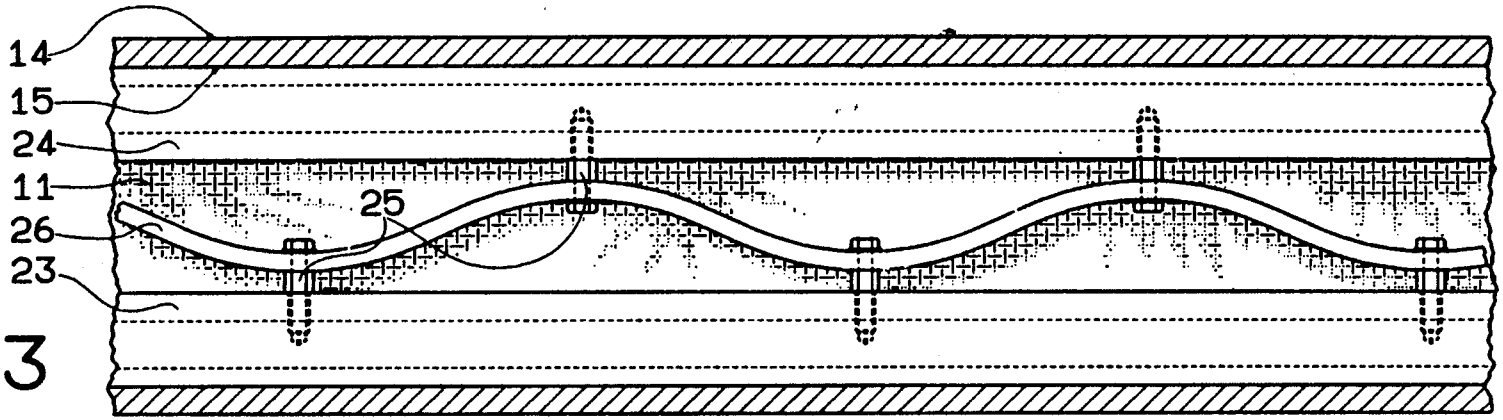
FIG. 3

CONTINUOUS-WORM CIGARETTE-MAKING MACHINE

BACKGROUND OF THE INVENTION

The present invention relates to a continuous-worm cigarette-making machine.

More in particular, the present invention relates to a conveyor system adapted to form a continuous layer of tobacco and to feed it to means for forming the so-called continuous cigarette worm.

Cigarette-making machines of the above described type are known which use a substantially vertical duct or chimney which is fed, at its lower end, with a continuous flow of tobacco particles and is upwardly closed by the lower stringer of an air-permeable conveyor belt closed in a loop around end rollers.

Inside the loop defined by said belt there is a chamber connected to a suction source and downwardly closed by a perforated plate; the lower stringer of the conveyor advances in contact with said plate.

Said plate constitutes a guiding and contrast element for said lower stringer, which extends in its direction of advancement beyond the outlet of the vertical chimney up to a position, termed discharge position, arranged at the intersection with the feeding path of a strip of cigarette paper.

The tobacco particles, pushed by a rising air current, rise through the vertical chimney and adhere to the lower stringer of the air-permeable belt due to the suction exerted by said chamber through the perforated wall and said belt, forming a substantially uniform layer of tobacco particles on said belt by accumulation.

This layer, still retained by suction by the conveyor belt, is transferred from the outlet of the vertical chimney to said discharge position, where it is deposited on the strip of cigarette paper.

The paper strip is then progressively closed on the tobacco layer so as to form the so-called continuous cigarette worm. The individual cigarettes are obtained from said worm by cutting.

In known cigarette-making machines, it has been observed that the use of the above mentioned perforated plate for the contrast and guiding of the lower stringer of the suction belt causes some disadvantages.

First of all, said plate reduces the suction force on said lower stringer intended to form and transfer the tobacco layer.

Tobacco dust furthermore penetrates and deposits itself between said lower belt stringer and the perforated plate and tends to obstruct the holes of said plate.

Finally, the high-speed flow of air through the holes of the plate causes a considerable increase in the noise of the machine.

SUMMARY OF THE INVENTION

The aim of the present invention is to provide a cigarette-making machine of the above described type which avoids the disadvantages described with reference to the known art.

This aim is achieved by the present invention, as it relates to a continuous-worm cigarette-making machine comprising a chimney for upwardly feeding a continuous flow of tobacco particles, a conveyor for forming and transferring a layer of tobacco particles, said conveyor being constituted by an air-permeable belt closed in a loop around two end rollers which define, in said belt, a stringer arranged at the upper outlet end of said chimney, a box-like body internal to said loop and downwardly delimited by a wall in contact with said stringer, and suction means connected to said box-like body, said cigarette-making machine being characterized in that said box-like body has a longitudinal opening, closed by said stringer, and internally comprises a contrast element arranged in contact with said stringer, so as to oppose the action exerted thereon through said longitudinal opening by said suction means.

BRIEF DESCRIPTION OF THE DRAWINGS

The invention is now described merely by way of non-limitative example with reference to the accompanying drawings, wherein:

FIG. 1 is a partially sectional front view of a cigarette-making machine according to the present invention;

FIG. 2 is a cross-sectional view of a detail of FIG. 1 taken along line II—II;

FIG. 3 is a horizontal longitudinal section taken along line III—III of FIG. 1 and showing a second embodiment of a detail of FIG. 1.

DESCRIPTION OF THE PREFERRED EMBODIMENTS

With reference to FIG. 1, the reference numeral 1 generally indicates a continuous-worm cigarette-making machine.

The machine 1 comprises a section 2 for forming a layer of tobacco 3 and a section 4 for wrapping said layer 3 in a paper strip 5 to produce the individual cigarettes with known operations which are not illustrated.

The section 2 comprises a rising chimney 6 over which there is a conveyor 7 constituted by an air-permeable belt made of textile material or of perforated metallic material, wound in a loop around end rollers 8 and 9 which rotate clockwise. In this manner, the rollers 8 and 9 divide the belt conveyor 7 into an upper stringer 10 and lower stringer 11 arranged facing the outlet of the rising chimney 6.

According to what is also illustrated in FIG. 2, the stringers 10 and 11 advance in contact respectively with an upper wall 12 and with a lower wall 13 of a box-like body 14 interposed between said stringers and defining, in its interior, a chamber 15 to which suction means, schematically indicated by a duct 16, are connected.

In particular, the lower stringer 11 advances between two vertical shoulders 17 and 18 rigidly associated with the box-like body 14 and is arranged so as to close a longitudinal opening 19 provided in the wall 13 and connected to the chamber 15.

The lower stringer 11, interposed between the chimney 6 and the chamber 15, extends its left end to a position 20, termed discharge position, arranged at the intersection with the feeding path of the cigarette-paper strip 5.

A known shaving device 21, capable of reducing and levelling the thickness of said tobacco layer 3, is arranged after the rising chimney 6 with reference to the direction of advancement of the stringer 11 and ahead of the discharge position 20.

Inside the chamber 15 there is a rectilinear strip or lamina 22 arranged in a plane substantially parallel to two walls 23 and 24 of the chamber 15 which define the opening 19. As can be seen from the drawing strip 22 is continuous.

Said strip 22 is supported by the wall 24 through fixing means 25 and its lower edge or surface defined by its peripheral boundary is in contact with the upper face of the stringer 11 so as to constitute a contrast element for the latter at the longitudinal opening 19. In fact, the lower surface of the contrast element strip 22 in contact with the upper face of the stringer 11 is, contrary to the perforated plates of known devices previously described, a continuous holeless or slotless surface that is therefore air-impervious in its entirety defined inside its peripheral boundry.

When the machine 1 is in operating condition, a continuous flow of tobacco particles, fed by known means not illustrated, rises through the chimney 6 until it reaches the stringer 11 of the air-permeable conveyor 7. Under the action of said suction source acting inside the chamber 15, the tobacco particles adhere to the stringer 11, which is movable in the direction indicated by the arrow F, and accumulate on one another until a layer 3 of tobacco of substantially uniform thickness forms in the recess defined by said stringer 11 and by the two vertical shoulders 17 and 18.

Outside the chimney 6, the tobacco layer 3 is shaved by the shaving device 21 and is finally deposited on the paper strip 5 in the discharge position 20.

The operations for wrapping the tobacco layer 3 in the paper strip 5 are then performed by the section 4, according to the known art, to produce the individual cigarettes.

It should be noted that the strip 22, though it perfectly achieves the purpose of contrasting the action of the suction force which tends to curve the stringer 11 upwards, has none of the typical disadvantages of the perforated plates used in the known art, i.e. it causes no pressure drops, no clogging due to tobacco dust, and no noise.

The fact is furthermore stressed that the contrast element according to the invention is considerably economically convenient with respect to the perforated plates of the known art.

According to the variated embodiment illustrated in FIG. 3, the contrast element is constituted by a strip or lamina 26 which is undulated in the plane of the stringer 11 and is fixed to both walls 23 and 24.

This configuration allows the strip 26 to exert a more uniform contrast action on the stringer 11 than the action obtained by means of a rectilinear strip 22.

What is claimed is:

1. A continuous-worm cigarette-making machine, comprising a chimney for upwardly feeding a continuous flow of tobacco particles, a conveyor for forming and transferring a layer of tobacco particles, said conveyor comprising an air-permeable belt closed in a loop around two end rollers which define in said belt a stringer arranged at an upper outlet end of said chimney, a box-like body internal to said loop and downwardly delimited by a wall in contact with said stringer, suction means connected to said box-like body, a longitudinal opening inside said box-like body closed by said stringer, a contrast element internal to said box-like body arranged in contact with said stringer so as to oppose the action exerted on said stringer, through said longitudinal opening, by said suction means, wherein said contrast element comprises a strip in contact with said stringer at its lower edge, wherein said strip is undulated in the plane of said stringer.

2. A continuous-worm cigarette-making machine, comprising a chimney for upwardly feeding a continuous flow of tobacco particles, a conveyor for forming and transferring a layer of tobacco particles, said conveyor comprising an air-permeable belt closed in a loop around at least two rollers which define in said belt a stringer arranged at an upper outlet end of said chimney, a box-like body internal to said loop and downwardly delimited by a wall in contact with said stringer, suction means connected to said box-like body, an opening inside said box-like body closed by said stringer, a contrast element internal to said box-like body arranged in contact with said stringer so as to oppose the action exerted on said stringer, through said opening, by said suction means, wherein said contrast element comprises a strip having a lower surface in contact with said stringer, said lower surface defining a perimetral boundary entirely encompassing said lower surface therein, said lower surface being a continuous holeless and air-impervious surface inside said perimetral boundary thereof.

* * * * *